US006731245B1

(12) United States Patent
Stotler et al.

(10) Patent No.: US 6,731,245 B1
(45) Date of Patent: May 4, 2004

(54) COMPACT CONFORMAL PATCH ANTENNA

(75) Inventors: Monte S. Stotler, McKinney, TX (US); Joseph E. Wheeler, Plano, TX (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 10/269,175

(22) Filed: Oct. 11, 2002

(51) Int. Cl.[7] ..... H01Q 1/38

(52) U.S. Cl. ..... 343/700 MS; 343/702; 343/770

(58) Field of Search ..... 343/700 MS, 702, 343/767, 770, 846, 848

(56) References Cited

U.S. PATENT DOCUMENTS 4,547,779 A * 10/1985 Sanford et al. ..... 343/700 MS
4,980,692 A * 12/1990 Rudish et al. ..... 343/700 MS
5,321,411 A * 6/1994 Tsukamoto et al. .. 343/700 MS
6,411,258 B1 * 6/2002 Ho ..... 343/700 MS
6,462,711 B1 * 10/2002 Zaghloul et al. ..... 343/700 MS
6,583,766 B1 * 6/2003 Rawnick et al. ..... 343/841

* cited by examiner

*Primary Examiner*—Tan Ho
(74) *Attorney, Agent, or Firm*—Gregory J. Gorrie; Thomas J. Finn; Glenn H. Lenzen, Jr.

(57) ABSTRACT

A conformal patch antenna comprises an aperture layer having an at least partially metallized surface that may have at least one aperture slot therein, and a feed-network layer positioned adjacent to the aperture layer and having a feed-network circuitry metallized thereon. The aperture layer and feed-network layer may be comprised of a low permittivity dielectric material. The dielectric material of the aperture and the feed-network layers may be formed in a predetermined shape by a molding process prior to metallization. The feed network may be located within a recessed area of the feed-network layer dielectric, and may include at least one signal probe molded in the dielectric material and having metallization thereon to align with holes in aperture layer. The signal probes may couple signals from the aperture to the feed-network circuitry.

26 Claims, 5 Drawing Sheets

COMPACT CONFORMAL PATCH ANTENNA

TECHNICAL FIELD

The present invention pertains to antennas, and in particular, to patch antennas, and more particularly to patch antennas and methods of assembly and fabrication of patch antennas.

BACKGROUND

Patch antennas are used in a variety of applications and are particularly useful on aircraft and guided projectiles where size, space and weight are important considerations. One problem with patch antennas is that to reduce aperture size, apertures carriers with greater permittivity have been conventionally used. This conventional approach may result in higher material costs, limitations on conformality and decreased bandwidth. The use of greater permittivity aperture carriers may require larger apertures with higher resonant frequencies. This conventional approach may also result in increased RF performance error requiring extensive band tuning. Some conventional patch antennas use multiple printed circuit boards, which require numerous piece parts and excessive touch labor for assembly, tuning and testing. These conventional patch antennas result in high cost and generally provide marginal performance.

Thus there is a general need for an improved patch antenna and improved method of fabrication and assembly of a conformal patch antenna. There is also a need for a conformal patch antenna and method of fabrication and assembly that may result in reduced assembly time, piece-part reduction, and a reduction in touch labor. There is also a need for a conformal patch antenna and method of fabrication and assembly with significantly reduced cost. There is also a need for a conformal patch antenna with improved bandwidth over conventional patch antennas. There is also a need for a conformal patch antenna with a flatter band response, which may be desirable for applications performing adaptive nulling and which may help eliminate tuning. There is also a need for a conformal patch antenna that permits a higher permittivity aperture carrier without an increase in aperture size or increase in resonant frequency. There is also a need for a conformal patch antenna suitable for acquisition of GPS signals that may be gun hardened. There is also a need for a conformal, low-cost, low-permittivity, broadband and compact patch antenna and method of fabricating such an antenna.

SUMMARY OF THE INVENTION

In accordance with embodiments of the present invention, a patch antenna comprises an aperture layer having an at least partially metallized surface. The aperture layer may have at least one aperture slot therein. The patch antenna also comprises a feed-network layer positioned adjacent to the aperture layer with a feed network metallized thereon. The aperture layer and feed-network layer may be comprised of a dielectric material having a low permittivity. The dielectric material of the aperture layer and the dielectric material of the feed-network layer may be formed in a predetermined shape by a molding process prior to metallization. The predetermined shape may, for example, be flat, or be a complex surface such as a portion of a conical, cylindrical or spherical surface. The feed network may be located within a recessed area of the feed-network layer. The feed-network layer may include at least one signal probe molded in the dielectric material and may have metallization thereon. The signal probes may also align with holes in aperture layer. An adhesive layer, ultrasonic staking/welding, or bonding method may be used to adhere the aperture layer to the feed-network layer. In one embodiment, the at least partially metallized surface of the aperture layer has up to four or more V-shaped slots circumferentially arranged therein.

In accordance with another embodiment of the present invention, an antenna system for receiving signals is provided. In this embodiment, the system includes an array of conformal patch antennas, and a combining element to combine RF signals received by the patch antennas. Each conformal patch antenna may be comprised of an aperture layer having an at least partially metallized surface that may have at least one aperture slot therein, and a feed-network layer positioned adjacent to the aperture layer and having a feed network metallized thereon. The feed network of each of the patch antennas may combine the signal components received through the aperture layer in a combining junction and provide the signals to the combining element. In this embodiment, each of the conformal patch antennas may have a substantially conical surface. The partially metallized surface of the aperture layers may have four V-shaped slots therein to form an aperture for receipt of the signals. The feed network may include circuitry to phase shift signals received approximately ninety degrees with respect to signals received through adjacent probes prior to combining by the feed network. The feed network may be designed to receive any RF signals, including circularly polarized signals and circularly polarized GPS signals. In one embodiment, the array of conformal patch antennas may be located beneath a substantially conical shaped radome such that the substantially conical surfaces of the aperture layers of the patch antennas at least in part conform to an inside surface of the radome. In this embodiment, the antenna system may be part of a guided projectile and the combined signal may be provided to a guidance system of the projectile for guidance to target coordinates utilizing GPS signals received by the patch antennas.

In yet other embodiments, the present invention provides a method of making a conformal patch antenna. The method may comprise generating a pre-shaped dielectric portion of an aperture layer and a feed-network layer, applying metallization to at least a portion of a surface of the dielectric portion of the aperture layer, and applying metallization to a recessed area of the dielectric portion of the feed-network layer. The method may also comprise providing a feed network in the metallization of the feed-network layer, providing at least one slot in the metallization on one of the surfaces of the aperture layer, and joining the aperture layer and feed-network layers to form the antenna. In one embodiment, generating the pre-shaped dielectric portions comprises molding dielectric material into either a portion of a conical, cylindrical or spherical surface to separately generate the dielectric portions of the aperture layer and feed-network layer. The method may also include joining the aperture layer and the feed-network layer with an adhesive or using an ultrasonic bonding/staking process.

BRIEF DESCRIPTION OF THE DRAWINGS

The appended claims are directed to some of the various embodiments of the present invention. However, the detailed description presents a more complete understanding of the present invention when considered in connection with the figures, wherein like reference numbers refer to similar items throughout the figures and:

DETAILED DESCRIPTION

The following description and the drawings illustrate specific embodiments of the invention sufficiently to enable those skilled in the art to practice it. Other embodiments may incorporate structural, logical, electrical, process, and other changes. Examples merely typify possible variations. Individual components and functions are optional unless explicitly required, and the sequence of operations may vary. Portions and features of some embodiments may be included in or substituted for those of others. The scope of the invention encompasses the full ambit of the claims and all available equivalents.

The present invention provides, in various embodiments, a conformal patch antenna and method of assembly and fabrication of a conformal patch antenna. When compared with conventional patch antennas, the conformal patch antenna of an embodiment of the present invention may result in reduced assembly time, piece-part reduction, and a reduction in touch labor resulting in significantly reduced cost. The present invention may also provide a conformal patch antenna with improved bandwidth (e.g., up to three times or greater) over conventional patch antennas, and may provide a flatter band response, which may be desirable for applications performing adaptive nulling. The flatter band response may also reduce and help eliminate tuning. The present invention may also provide a conformal patch antenna with a reduced aperture size. The present invention may also provide a conformal patch antenna suitable for acquisition of GPS signals, adaptive nulling and gun hardening. In one embodiment, a conformal, low-cost, low-permittivity, broadband and compact patch antenna is provided. In one embodiment, a streamlined wide-application patch (SWAP) approach to antenna technology is provided. In embodiments with one or more aperture slots, the aperture slots may reduce the resonant frequency and allow for a reduction in size of the aperture, compensating for the size-increasing effect of lower-permittivity aperture materials.

Figure 1:
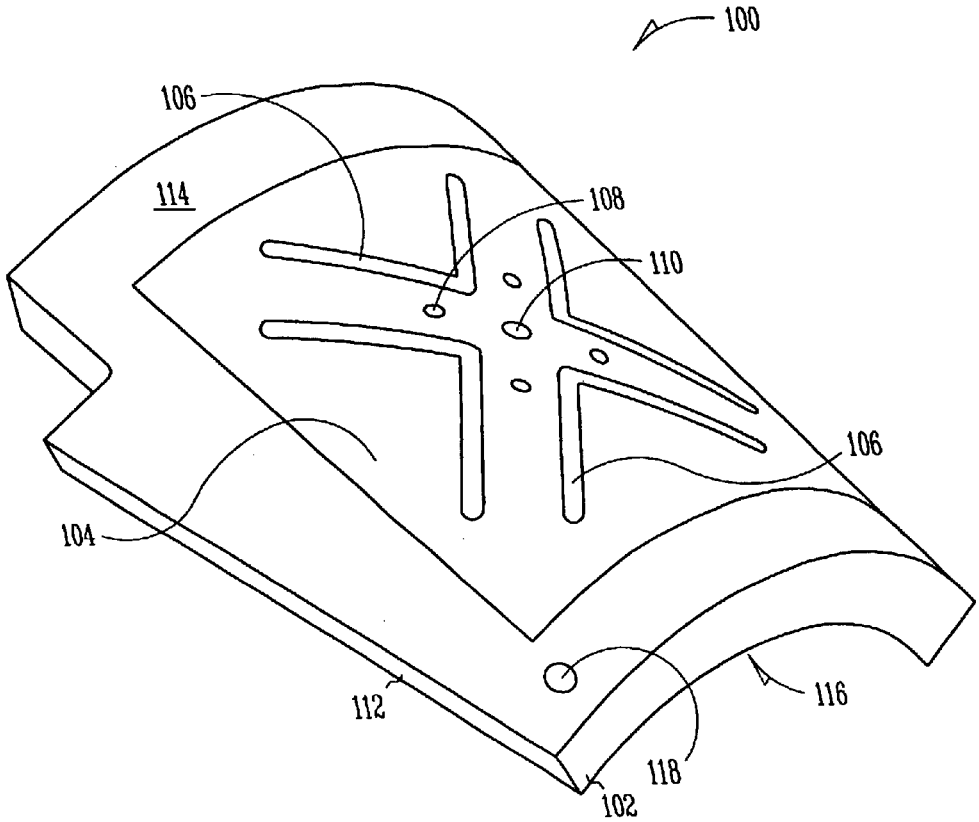
FIG. 1 illustrates an aperture layer of a conformal patch antenna in accordance with an embodiment of the present invention.
Figure 2:
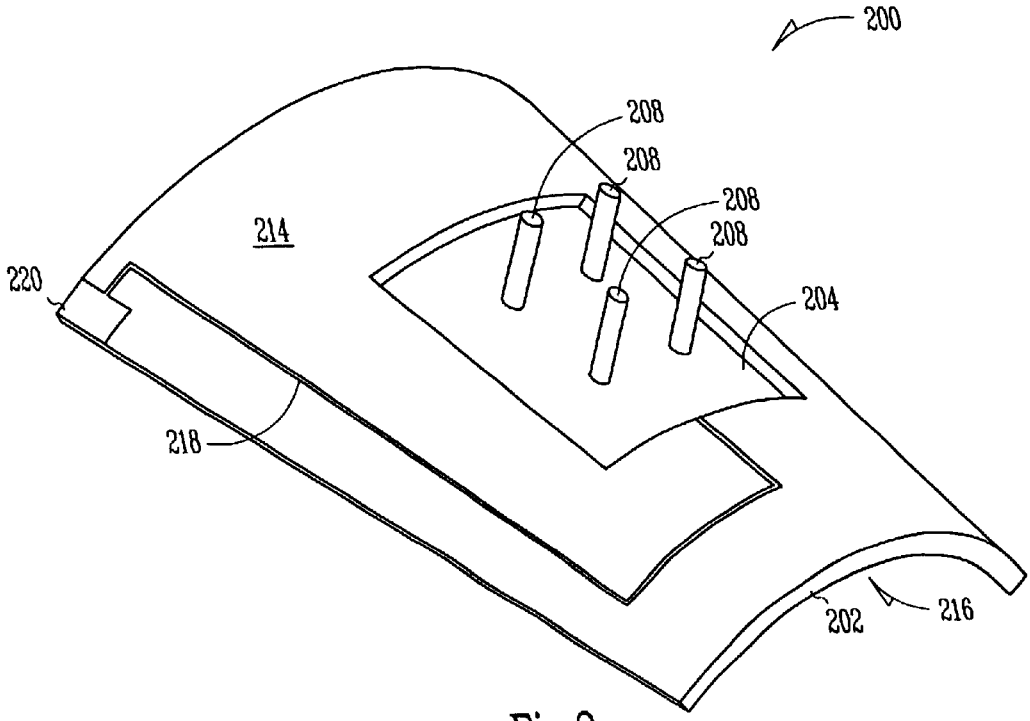
FIG. 2 illustrates a feed-network layer of a conformal patch antenna in accordance with an embodiment of the present invention.

FIG. 1 illustrates an aperture layer of a conformal patch antenna in accordance with an embodiment of the present invention. FIG. 2 illustrates a feed-network layer of a conformal patch antenna in accordance with an embodiment of the present invention. Aperture layer 100 and feed-network layer 200 together comprise several embodiments of the conformal patch antenna of the present invention. Aperture layer 100 is comprised of aperture dielectric portion 102 and aperture metallization 104 on surface 114 of the dielectric. Dielectric portion 102 may be formed by a molding process, which forms dielectric portion 102 in a predetermined shape. In various embodiments, surface 114 of dielectric portion 102 may be substantially flat or may be a complex surface such as a portion of a conical, a cylindrical or a spherical surface. Dielectric portion 102 is illustrated in FIG. 1 as a portion of a conical surface.

Metallization 104 may have one or more slots 106 therein allowing for receipt (or transmission) of RF signals and may define an aperture for the antenna. In one embodiment, metallization 104 may have four V-shaped slots 106, as illustrated in FIG. 1. Slots 106 may reduce the resonant frequency and allow for a reduction in size of the aperture, compensating for the size-increasing effect of lower-permittivity aperture materials used at least for dielectric portion 102. In one embodiment, slots 106 may be arranged circumferentially as illustrated. Slots 106 may have other shapes depending on the particular application. In one embodiment, metallization 104 may be present on a portion of surface 114. In FIG. 1, metallization 104 is illustrated as having a substantially square shape on a portion of surface 114, although this is not a requirement. In one embodiment, V-shaped slots 106 may reduce the antenna's resonant frequency by forcing currents to flow around the slots. Current may flow to the top surface of the patch via the slots in addition to the conventional means (e.g., from the edges), which may help reduce the "Q" of the antenna and may result in increased bandwidth.

Aperture layer 100 may also have metallization on surface 116 which is opposite of surface 114. Aperture layer 100 may also have metallization 112 on one or more side surfaces 112 of dielectric portion 102.

Feed-network layer 200 is comprised of a feed-layer dielectric portion 202 and feed-network circuitry (not illustrated in FIG. 2) located in recess 204. Dielectric portion 202 may be formed by a molding process, which forms dielectric portion 202 in a predetermined shape. In various embodiments, surface 214 of dielectric portion 102 may be substantially flat, or may form a complex surface such as a portion of conical, cylindrical or spherical surface. Surface 214 of dielectric portion 202 is illustrated in FIG. 2 as a portion of a conical surface. Feed-network layer 200 may also include one or more signal probes 208, which may be molded as part of dielectric portion 202 and may be metallized.

Aperture layer 100 may have one or more signal probe holes 108 and at least one grounding hole 110 through dielectric portion 102 and metallization 104. Aperture layer 100 and feed-network layer 200 may have one or more alignment and mounting holes 118, which may be used for mounting and aligning the antenna on a structure. In one embodiment, the holes may be molded during the formation of dielectric portions. In alternate embodiments, the holes may be drilled or punched after formation of the dielectric portions. In one embodiment, slots 106 may be arranged circumferentially around a ground provided through ground hole 110.

Feed-network layer 200 may also include grounding metallization on surface 216, which is on a side opposite the feed-network circuitry. This metallization may provide a grounding plane for the feed-network circuitry. Feed-network layer 200 may also include signal path 218 for coupling the feed-network circuitry to receptacle pad 220 to allow the feed-network circuitry to be coupled to external circuitry.

Aperture layer 100 and feed-network layer 200 may fit together so that surface 116 meets/aligns with surface 214. In one embodiment, signal probes 208 may align with signal probe holes 108 when aperture layer 100 and feed-network layer 200 are fitted together. Because probes 208 may be metallized, they may be used to electrically couple aperture metallization 104 at holes 108 with the feed-network circuitry located in recess 204. A conductive adhesive, ultrasonic staking/welding, or other bonding methods may be used to join aperture layer 100 and feed-network layer 200. In one embodiment, a conductive adhesive may be a die-cut adhesive layer, which resides on the portion of surface 214 exclusive of recess 204. A gap at recess 204 may be formed between aperture layer 100 and feed-network layer 200 when they are joined together. The gap may, for example, contain air, an inert gas, or may be hermetically sealed. In one embodiment, signal probes 208 may be soldered to aperture layer metallization 104 after the aperture layer and feed-network layer are fitted together.

Metallization 104, any metallization on surfaces 112, 116, and 216, and metallization used for the feed-network circuitry, signal path 218 and receptacle pad 220, may be a conductive material such as gold or copper with tin-lead plating, although other conductive materials may also be suitable. Dielectric portions 102 and 202 may be comprised of any substantially non-conductive or dielectric material, although a low-permittivity dielectric, which has a dielectric constant approximately less than six may be suitable for some embodiments. Dielectric constants ranging between approximately two and four may be particularly suitable for some applications.

In one embodiment, a thirty-percent glass filled polyetherimide (PEI) may be a suitable dielectric material for use as aperture layer dielectric portion 102 and feed-network dielectric portion 202. In this embodiment, aperture layer dielectric portion 102 may be approximately 0.20 inches (0.5 cm) thick and feed-network dielectric layer 202 may be approximately 0.060 inches (0.15 cm) thick with a 0.030 inch (0.08 cm) recess. Aperture layer dielectric and feed-network layer dielectric may have other thicknesses depending on the properties of the dielectric material used and the application requirements.

In one embodiment, grounding hole 110 may be a molded feature of aperture layer dielectric 102 and may be thru-plated with metallization to provide a conductive path between aperture metallization 104 and metallization on surface 116. This grounding path is optional and may help with mode suppression in electromagnetic interference (EMI), electromagnetic pulse (EMP) and static electromagnetic (EM) effects.

Figure 3:
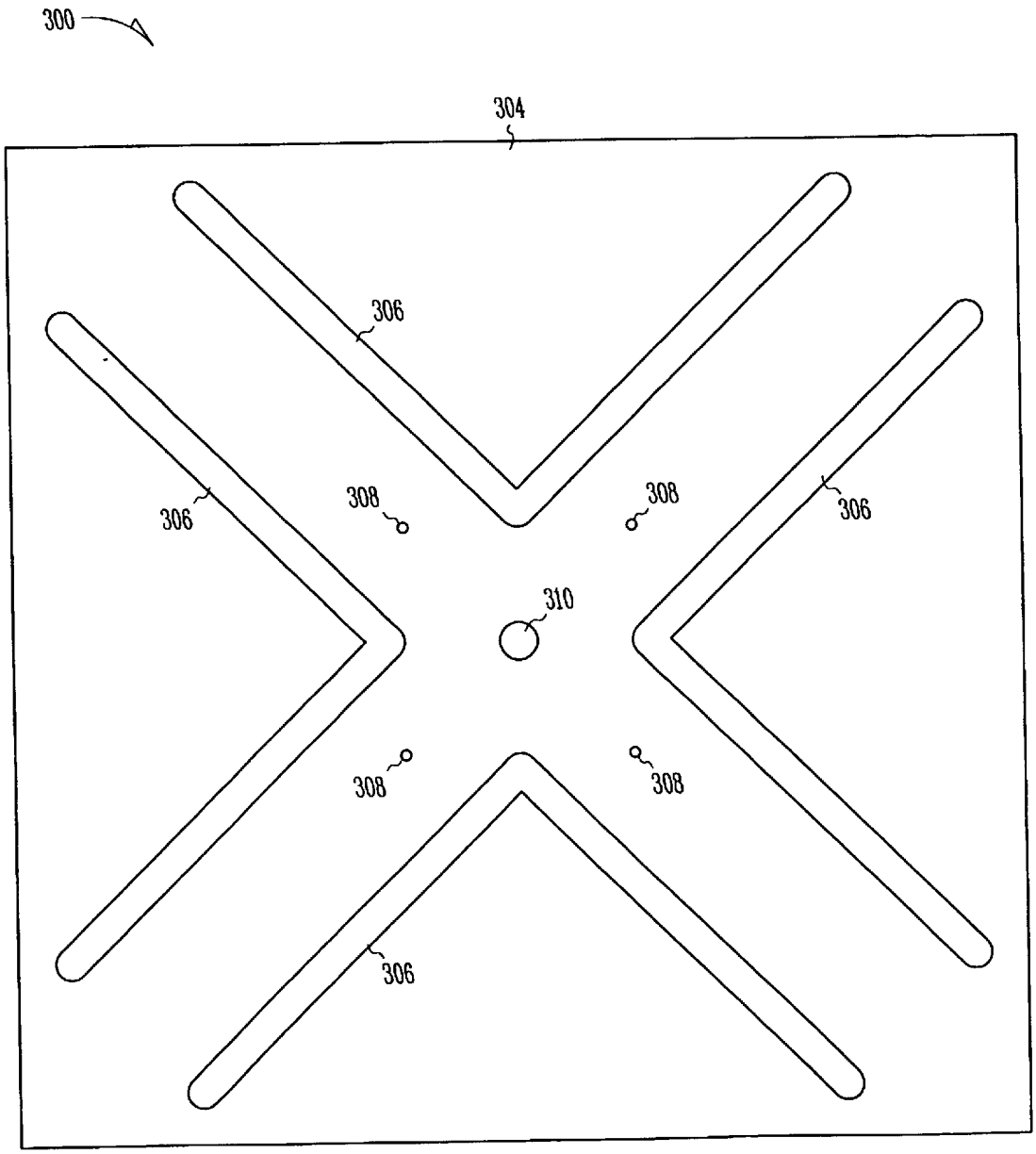
FIG. 3 illustrates an aperture of a conformal patch antenna in accordance with an embodiment of the present invention.

FIG. 3 illustrates an aperture of a conformal patch antenna in accordance with an embodiment of the present invention. Aperture 300 may be suitable for use as aperture metallization 104 (FIG. 1) of aperture layer 100, although other apertures are also suitable. Aperture 300 may include metallization 304 having one or more slots 306 therein for receipt (or transmission) of RF signals. Aperture 300 may also include one or more signal probe holes 308 which may be electrically coupled to signal probes which may carry RF signals to feed circuitry. Aperture 300 may also include grounding hole 310, which may be electrically coupled with a ground or grounding plane positioned at a zero voltage location. Metallization 304 may be fabricated on a dielectric surface, and in one embodiment, may be 3-D fabricated on a three-dimensional dielectric surface. For example, metallization 304 may be fabricated on a complex surface such as a conical, cylindrical or spherical surface of dielectric after the dielectric is already molded in shape.

In one embodiment, metallization 304 may correspond with metallization 104 (FIG. 1), slots 306 may correspond with slots 106 (FIG. 1), probe holes 308 may correspond with probe holes 108 (FIG. 1) and grounding hole 310 may correspond with grounding hole 10 (FIG. 1). In the example illustrated in FIG. 3, aperture 300 may be suitable for receipt and/or transmission of any RF signals.

In one embodiment, signal probes 208 (FIG. 2) may protrude through aperture layer dielectric 102 (FIG. 1) and may be substantially flush with surface 114 at holes 308 when aperture layer 100 (FIG. 1) and feed-network layer 200 (FIG. 2) are fitted together. In this embodiment, probes 208 (FIG. 2), located in holes 308, may be electrically coupled (e.g., by solder) to metallization 304. A ground at grounding hole 310 may be provided by metallization 304 electrically coupling with metallization on surface 116 (FIG. 1).

The number, arrangement, shape, width and length of slots 106 may be determined by one of ordinary skill in the art and may depend on the dielectric material and the particular application for which the antenna is to be used. In one embodiment, aperture metallization 304 may be substantially square having a length of between one and two inches (2.54 and 5.08 cm).

Figure 4:
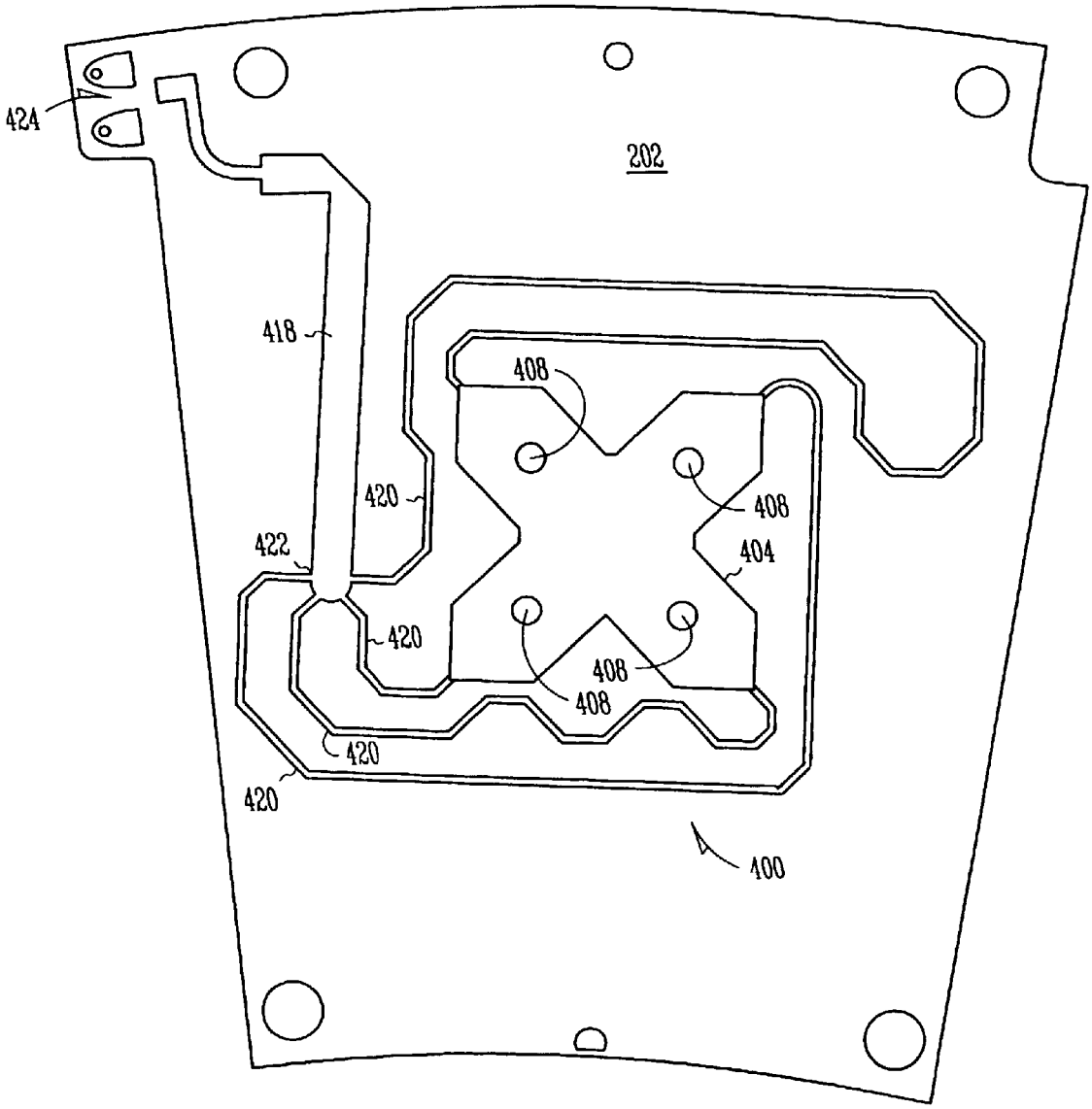
FIG. 4 illustrates feed-network circuitry of a conformal patch antenna in accordance with an embodiment of the present invention.

FIG. 4 illustrates feed-network circuitry of a conformal patch antenna in accordance with an embodiment of the present invention. Feed-network circuitry 400 may be used for the feed network located in recess 204 (FIG. 2) of feed-network layer 200 (FIG. 2) although other feed-network circuitry is also suitable. In one embodiment, feed-network circuitry 400 may be suitable for receiving circularly polarized signals, including circularly polarized GPS signals. Feed-network circuitry 400 may be comprised of metallization 404 formed on a dielectric material such as dielectric portion 202 (FIG. 2) and may be three-dimensionally formed on a three-dimensional dielectric surface. In operation, feed-network circuitry may receive RF signals or signal components from one or more signal probes 208 at locations 408 and may convey the RF signal or signal components by signal paths 420 to combining junction 422. In the case of circularly polarized signals, signal paths 420 may provide for a relative phase difference of approximately ninety degrees between quadrature signal components. Signal paths 420 may have lengths determined accordingly.

Feed-network circuitry 400 may also include signal path 418 to convey a combined signal to receptacle 424. In one embodiment, signal path 418 may correspond with signal path 218 (FIG. 2) and receptacle 424 may correspond with receptacle pad 220 (FIG. 2).

Figure 5:
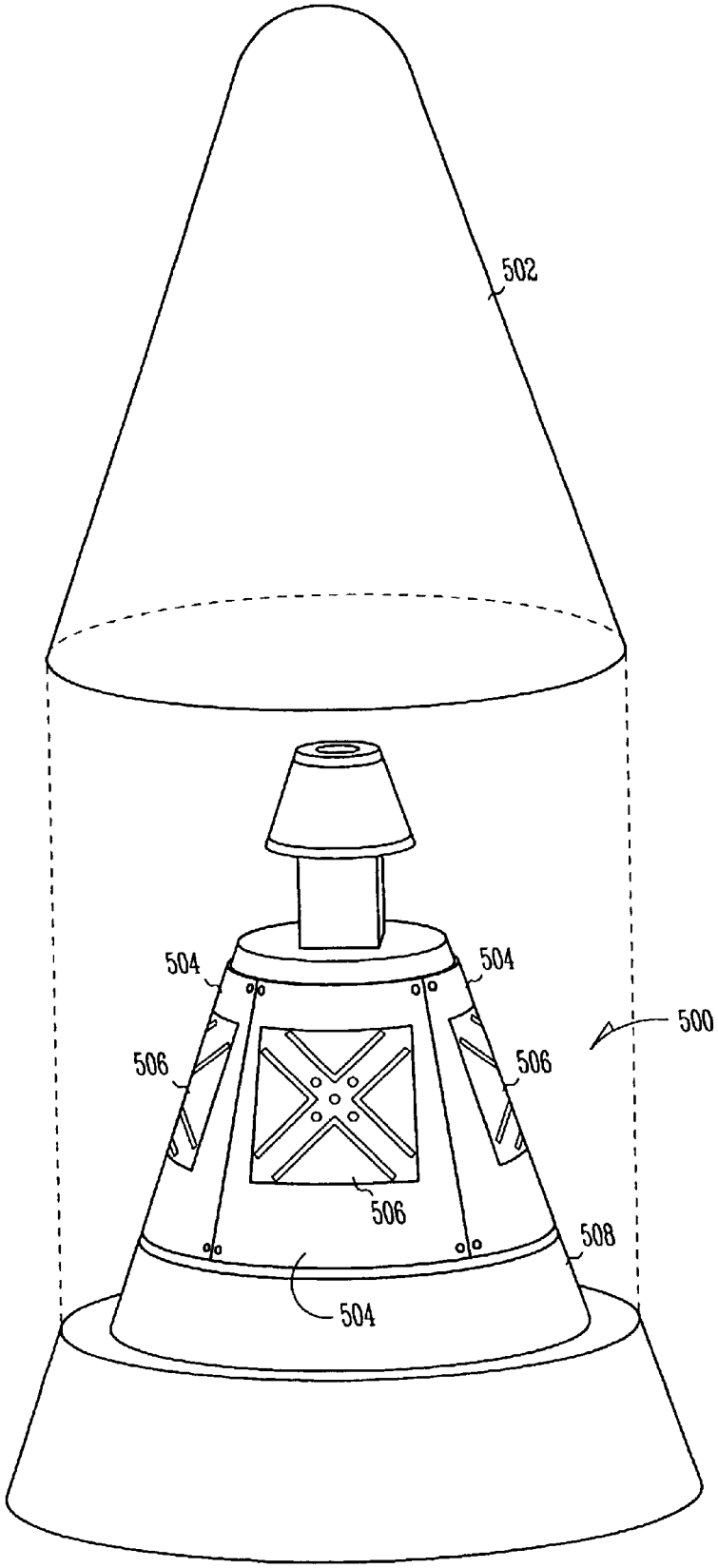
FIG. 5 illustrates an antenna system in accordance with an embodiment of the present invention.

FIG. 5 illustrates an antenna system in accordance with an embodiment of the present invention. Antenna system 500 may be suitable for receiving any RF signals, including circularly polarized signals, and may comprise an array of conformal patch antennas 504 having apertures 506. Antenna system 500 may also include a combining element (not illustrated) to combine signals received by the array patch antennas 504. In one embodiment, conformal patch antennas 504 may include an aperture layer, such as aperture layer 100 (FIG. 1) having an at least partially metallized surface that may have at least one aperture slot therein, and a feed-network layer, such as feed-network layer 200 (FIG. 2) positioned adjacent to the aperture layer and having a feed network metallized thereon. The feed network may provide signals received through the aperture layer to the combining element.

In one embodiment, the array of conformal patch antennas 504 may be located beneath radome 502 which may be substantially conical shaped. In this embodiment, conical surfaces of the aperture layers of the patch antennas 504 may at least in part conform to the inside surface of radome 502.

In one embodiment, antenna system 500 may be part of a guided projectile which may provide a combined signal from antennas 504 to a guidance system which may be located in guidance section 508 to guide the projectile to target coordinates utilizing received GPS signals.

Figure 6:
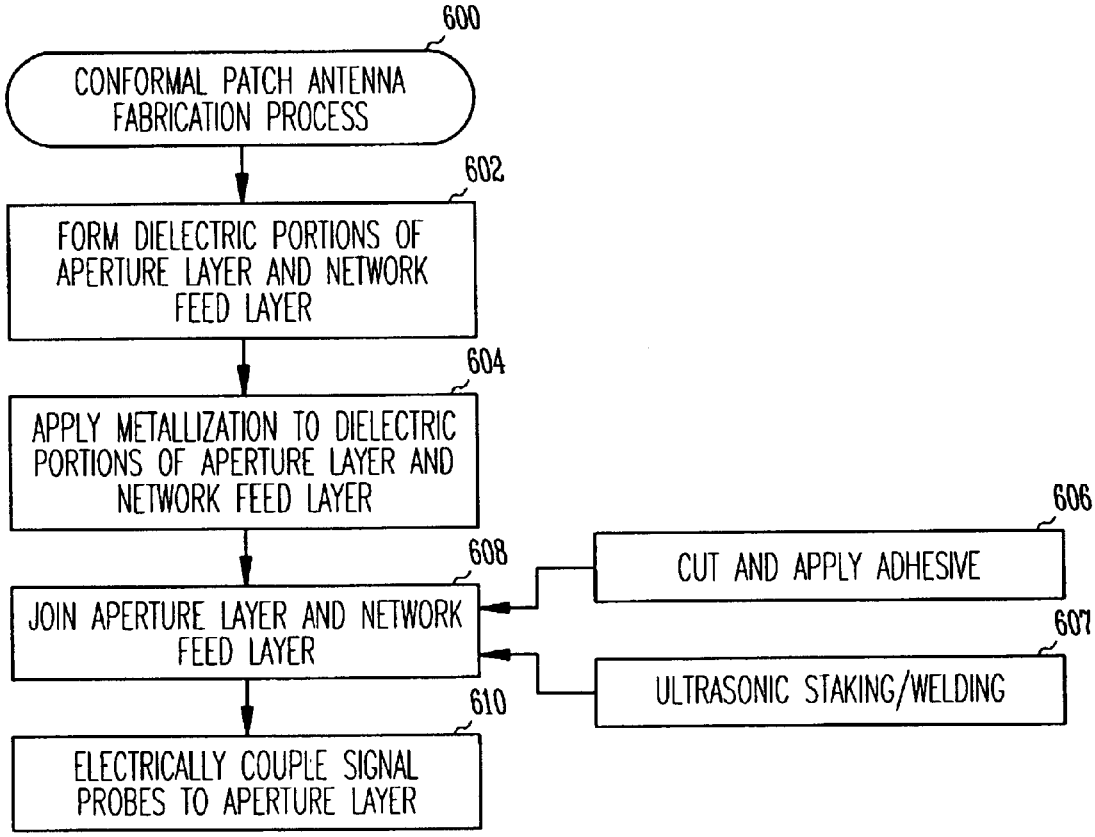
FIG. 6 is a flow chart of a conformal patch antenna fabrication and assembly procedure in accordance with an embodiment of the present invention.

FIG. 6 is a flow chart of a conformal patch antenna fabrication and assembly procedure in accordance with an embodiment of the present invention. Procedure 600 may be used to fabricate and assemble a conformal patch antenna, such as the patch antenna illustrated in FIGS. 1 and 2, although procedure 600 is suitable for the fabrication and assembly of other patch antennas. Although the individual operations of procedure 600 are illustrated and described as separate operations, one or more of the individual operations may be performed concurrently and nothing necessarily requires that the operations be performed in the order illustrated.

In operation 602, the dielectric portions of the aperture layer and the feed-network layer are formed. In one embodiment, the dielectric portions may be formed by a molding process, such as thermal-injection molding, thermal-compression molding or resin-transfer molding. The aperture layer dielectric portion and feed-network layer dielectric portions may be formed in substantially flat shape, or may be formed as a complex surface such as a portion of conical surface, a cylindrical surface or spherical surface. The dielectric portions may be comprised of any substantially non-conductive or dielectric material, although a low-permittivity dielectric, which has a dielectric constant approximately less than six is particularly suitable for some embodiments. In one embodiment, operation 602 forms dielectric portions 102 (FIG. 1) of aperture layer 100 (FIG. 1) and dielectric portion 202 (FIG. 2) of feed-network layer 200 (FIG. 2). Operation 602 may include forming, as part of a molding process, a recess, such as recess 204 (FIG. 2) and signal probes, such as signal probes 208 (FIG. 2) of feed-network layer 200 (FIG. 1), in addition to forming any holes in either the dielectric portions of either the aperture layer or the feed-network layer.

In one embodiment, a thirty-percent glass filled polyetherimide (PEI) may be a suitable dielectric material for the dielectric portions of either or both the aperture layer and the feed-network layer. In this embodiment, the aperture layer dielectric portion may be approximately 0.20 inches thick (0.5 cm) and the feed-network layer dielectric portion may be approximately 0.060 inches (0.15 cm) thick with a 0.030 inch (0.08 cm) recess. The aperture layer dielectric portion and feed-network layer dielectric portion may have other thicknesses depending on the application, and depending on size and performance requirements.

In operation 604, metallization is applied to the aperture layer dielectric and feed-network layer dielectric. The metallization may be applied to generate the aperture layer metallization 104 (FIG. 1) on the aperture layer dielectric, and to generate feed-network circuitry 404 (FIG. 4) on the feed-network layer dielectric. In one embodiment, the metallization may be applied through a three-dimensional circuit etch application. The metallization may be any conductive material such as gold or copper with tin-lead plating, although other conductive materials may also be suitable. In one embodiment, operation 604 may also include applying metallization to surfaces 112 (FIG. 1) and 116 (FIG. 1) of dielectric portion 102 (FIG. 1) and to surface 216 (FIG. 2) of dielectric portion 202 (FIG. 2). Operation 604 may also include metallizing signal probes 208 (FIG. 2) and in one embodiment, may include metallizing grounding hole 110 (FIG. 1) to electrically couple aperture metallization 104 (FIG. 1) with metallization on surface 116 (FIG. 1).

Operation 604 may also include forming one or more slots, such as slots 106 (FIG. 1) in the aperture layer metallization along with any other areas where metallization is not required. An etching process may form the slots, for example. In one embodiment, the aperture layer metallization on the aperture layer dielectric may form substantially a square and may range between one and two inches (2.54 and 5.1 cm) in length.

In operation 608, the aperture layer is joined with the feed-network layer. In one embodiment, the layers may be pressed together and in another embodiment, may be joined by the adhesive. In one embodiment, a bond film may be used to joint the two layers, and in another embodiment, an ultrasonic staking/welding technique may be used to join the two layers. In an alternate embodiment, the aperture layer and the feed-network layer may snap together with or without the use of an adhesive or may be joined using an ultrasonic staking or ultrasonic welding process, and/or an induction soldering technique previously discussed.

In embodiments that use an adhesive to join aperture layer and the feed-network layer, operation 606 may be performed. In operation 606, an adhesive may be applied to either or both the aperture layer and feed-network layer. In one embodiment the adhesive may be a die-cut adhesive layer in a shape to conform to a portion of the feed-network layer that is exclusive of the recess.

In embodiments that use an ultrasonic staking or ultrasonic welding process, operation 607 may be performed in which the aperture layer and the feed-network layer are joined using an ultrasonic staking/welding process. An induction soldering technique may also be used to help insure RF and grounding continuity.

In operation 610, the signal probes are electrically connected to the aperture layer metallization. In one embodiment, the signal probes may be soldered to the aperture layer metallization. An induction soldering technique may be used. In some embodiments, impedance-loading elements, such as resistive loads, may be electrically coupled to the aperture (e.g., to help improve a circularly polarized sense for a multiple driven feed network).

Thus, various embodiments of a conformal patch antenna and method of assembly and fabrication have been described. The conformal patch antenna and method of assembly and fabrication of embodiments of the present invention, when compared with conventional patch antennas, may result in reduced assembly time, piece-part reduction, and a reduction in touch labor resulting in significantly reduced cost. The conformal patch antenna and method of assembly and fabrication of embodiments of the present invention, may also achieve an improved bandwidth (e.g., up to three times or greater), and may provide a flatter band response, which may be desirable for applications performing adaptive nulling. The flatter band response may also reduce and help eliminate tuning. In one embodiment, a conformal, low-cost, low-permittivity, broadband and compact patch antenna has been described.

The foregoing description of specific embodiments reveals the general nature of the invention sufficiently that others can, by applying current knowledge, readily modify and/or adapt it for various applications without departing from the generic concept. Therefore such adaptations and modifications are within the meaning and range of equivalents of the disclosed embodiments. The phraseology or terminology employed herein is for the purpose of description and not of limitation. Accordingly, the invention embraces all such alternatives, modifications, equivalents and variations as fall within the spirit and scope of the appended claims.

What is claimed is:

1. A patch antenna comprising:

an aperture layer having an at least partially metallized surface with at least one aperture slot therein; and a feed-network layer positioned adjacent to the aperture layer and having a feed network metallized thereon, wherein the feed network is located within a recessed area of the feed-network layer.

2. The antenna of claim 1 further comprising an adhesive layer to adhere the aperture layer to the feed-network layer, the adhesive layer exclusive of the recessed area.

3. The antenna of claim 1 wherein the aperture layer and the feed-network layer are joined using an ultrasonic staking/welding process.

4. The antenna of claim 1 wherein the aperture layer and feed-network layer are comprised of a dielectric material having a low permittivity.

5. The antenna of claim 4 wherein the permittivity is less than approximately six.

6. The antenna of claim 4 wherein the dielectric material of the aperture layer and the dielectric material of the feed-network layer are formed to be a predetermined shape by a molding process prior to metallization.

7. The antenna of claim 6 wherein the predetermined shape is a complex surface comprising a portion of either a conical, spherical or cylindrical surface.

8. The antenna of claim 1 wherein a gap between the aperture layer and feed-network layer is present adjacent to a recessed area, the gap having either air or an inert gas.

9. The antenna of claim 1 wherein the aperture layer is comprised of a dielectric material having a low permittivity, and wherein the at least partially metallized surface of the aperture layer has four V-shaped slots circumferentially arranged thereon, the slots effectively allowing the dielectric material to have the low permittivity, the low permittivity being less that approximately six.

10. The antenna of claim 1 wherein the feed network is etched from metallization within a recessed area of the feed-network layer.

11. The antenna of claim 1 wherein the feed-network layer includes at least one probe molded in a dielectric material of the feed-network layer and having metallization thereon to align with holes in the aperture layer.

12. The antenna of claim 1 wherein the feed-network layer includes a receptacle pad thereon to interface the feed network with external circuitry.

13. An antenna system comprising:

an array of conformal patch antennas; and a combining element to combine signals received by the patch antennas, wherein each conformal patch antenna is comprised of:

an aperture layer having an at least partially metallized surface at least one aperture slot therein, a feed-network layer positioned adjacent to the aperture layer; and a feed network metallized within a recessed area of said feed-network layer, the feed network providing the signals received through the aperture layer to the combining element.

14. The antenna system of claim 13 wherein the aperture layer of each of the conformal patch antennas has a substantially conical surface.

15. The antenna system of claim 14 wherein the partially metallized surface of the aperture layers have four V-shaped slots therein to form an aperture, and wherein the feed network includes circuitry to phase shift signals approximately ninety degrees prior to combining in a combining junction of the feed network.

16. The antenna system of claim 15 wherein the aperture layer is comprised of a dielectric material having the at least partially metallized surface thereon, and wherein the feed-network layer is comprised of the dielectric with a recessed area having the feed network metallized therein, the dielectric material having a permittivity of less than approximately six.

17. The antenna system of claim 16 wherein the feed-network layer includes a plurality of metallized probes to protrude through holes in the dielectric material of the aperture layer, the metallized probes electrically connected to the at least partially metallized surface of the aperture layer.

18. The antenna system of claim 17 wherein the V-shaped slots are arranged circumferentially around a grounding location, the grounding location being coupled to a ground plane of the aperture layer.

19. The antenna system of claim 14 wherein the plurality of conformal patch antennas are located beneath a substantially conical shaped radome, wherein the substantially conical surfaces of the aperture layers of the patch antennas at least in part conform to an inside surface of the radome.

20. The antenna system of claim 19 wherein the antenna system is part of a guided projectile and wherein the combined signal is provided to a guidance system of the project to guide the projectile to target coordinates utilizing GPS signals received by the patch antennas.

21. A method of making a conformal patch antenna comprising:

generating a pre-shaped dielectric portion of an aperture layer and a feed-network layer;

applying metallization to at least a portion of a surface of the dielectric portion of the aperture layer to provide an aperture;

applying metallization to a recessed area of the dielectric portion of the feed-network layer to provide a feed network; and joining the aperture layer and feed-network layer to form the antenna.

22. The method of claim 21 wherein generating comprises molding dielectric material into a complex surface including either a portion of a conical, cylindrical or spherical surface to separately generate the dielectric portions of the aperture layer and feed-network layer.

23. The method of claim 22 wherein molding the dielectric portion of the feed-network layer includes molding a plurality of probes, and wherein molding the dielectric portion of the feed-network layer includes molding a plurality of holes therein, the probes to align with the holes, and wherein applying metallization to the portion of the surface of the dielectric portion of the aperture layer comprises applying metallization to the probes.

24. The method of claim 22 wherein joining include ultrasonic welding the aperture layer and feed-network layer.

25. The method of claim 21 further comprising:

etching the feed network includes the feed network in the metallization of the feed-network layer; and etching at least one slot in the metallization on the portion of the surface of the aperture layer to provide the aperture, and wherein joining comprises joining the aperture layer and feed-network layers with an adhesive, and wherein the method further comprises electrically connecting probes of the feed-network layer to the metallization of aperture layer, the probes aligning with holes in the aperture layer.

26. The method of claim 25 wherein the etching the metallization on the aperture layer comprises etching four V-shaped slots in the metallization.

* * * * *